United States Patent [19]

Black

[11] Patent Number: 4,898,122

[45] Date of Patent: Feb. 6, 1990

[54] TILE MOUNTING SYSTEM

[76] Inventor: James Black, c/o The Manor House, Lawrence Street, York, Y01 3EF, England

[21] Appl. No.: 215,636

[22] Filed: Jul. 6, 1988

[30] Foreign Application Priority Data

Jul. 6, 1987 [GB] United Kingdom ..... 8715871

[51] Int. Cl.[4] ..... F22B 37/00

[52] U.S. Cl. ..... 122/6 A; 110/336; 110/339

[58] Field of Search ..... 110/336, 339, 182.5; 122/6 A

[56] References Cited

U.S. PATENT DOCUMENTS

| | | | |
|---|---|---|---|
| 4,317,418 | 3/1982 | Courshow, Jr. et al | 110/339 X |
| 4,463,689 | 8/1984 | James | 110/339 X |
| 4,773,356 | 9/1988 | Black | 110/336 X |

*Primary Examiner*—Edward G. Favors

*Attorney, Agent, or Firm*—Ladas & Parry

[57] ABSTRACT

A locking system is provided for preferably locating ceramic tiles in furnace throats in which locking member engages in a recess in the rear surface of the tiles the other end being attached to part of the throat the head of the locking member and shaping of the recess permitting angling of the locking member in relation to the tile. This permits greater flexibility in mounting the tiles in the throat.

7 Claims, 3 Drawing Sheets

TILE MOUNTING SYSTEM

The invention relates to the support of tiles, conveniently ceramic tiles and more preferably refractory tiles particularly for use in forming flame-injection throats in or for boilers, to tiles for such use and to methods of mounting said tiles.

The mounting of tiles particularly refractory tiles in various non-horizontal surfaces has presented a number of problems. N.B. A special problem is foun in the flame-injection throats of boilers. These throats are usually surrounded by a series of water tubes which are embedded in refractory material. For many years it was the practice to weld studs to these tubes and to cover the tubes with a lining of silicon carbide refractory material, this material being applied to the throat in its raw condition and being cured while in situ in the throat. Welding of the pins to the tubes was time consuming and the bond between the silicon carbide and the pins was not wholly satisfactory as, although the surface of the material is hardened during curing, hardening of the interior was often not completely effective.

In recent years there have been introduced pre-fired silicon carbide tiles especially shaped for installation in the flame-injection throat. In the first form of these tiles they were secured by bolts welded to the tubes which passed through holes in the tiles and were secured by nut in a recess on the front face of the tile. These recesses were then filled with silicon carbide refractory material (see U.S. Pat. Nos. 3,793,995 and 3,815,891).

There was, however, a tendency for the material packed around the nut to become detached. In UK Patent 1,545,852 there is disclosed a refractory tile having a locating depression in the rear surface which engages a locating element for example a bolt with adjustable nut the front face of a tile being substantially smooth and free from recess.

In a variation described in U.S. Pat. No. 4,136,625 a locking member is provided which fits into grooves in the edges of the tiles and also engages the enlarged head of the pin or other member attached to the tube.

In other areas where tiles are mounted on inclined or vertical surfaces (or in the lower side of horizontal surfaces) this method of lockimg members can also be used. The locating member can be mounted by affixing to the surfaces in question.

A disadvantage of these constructions is that the locating members i.e. bolts (and nuts or other movable elements on the head of such bolts) are best located radially, for example by welding onto the tubes, and equally the natural of the recess in the tile or other means of holding the head of the bolt in the tile tends to mandate a perpendicular relationship between the bolt and the surface of the tile. Since it is not always possible to have such a perpendicular/radial relationship to every tile in relation to every tube, certain of the locating elements may have to be attached to the tube away from the "crown" of the tube i.e. the closest point of the tube to the tile. This may result in the bolt having greater than desirable length and also attachment may be difficult at a point distant from the crown since the welding would have to be at an angle to the radius.

According to the present invention there is provided a combination of ceramic tiles or locking members therefor and locating elements comprising, in the locating element, one end attachable to support means and the other end enlarged in relation to the body of the locating element and in a shaped tile or element for locking said tile to the support means a recess in a rear surface the internal dimension of which is greater than the entry into the recess, the dimensions of the interior of the recess, the entry and the head of the locating element and body of the locating element permitting the locating element to be positioned at an angle deviating from the perpendicular line through the tile and the recess in relation to the front face of the tile.

Preferably the head of the retaining element will comprise a rounded or spherical head which can be moved along the length of the body of the retaining element for example by means of a thread within the head and on the retaining element or bolt. The interior of the recess at the back of the tile can then also be circular in cross section. The throat or entry to this recess will then be sufficiently wide as to permit the bolt and head to be located at different angles to the perpendicular taken through the recess. By this means the bolt can be welded to the crown of the tube constituting part of the support means at an angle to the radius of the tube at the crown and enter the recess in the back of the tile at an angle to the perpendicular taken through the face of the tile. However the head need not be spherical but could be cone or angularly shaped, the portion in the back of the tile being correspondingly shaped providing the entry into the recess is sufficiently wide to permit angling of the locating elements to enter at a non-perpendicular angle. The sizing and shaping of the head can then be adjusted or constructed to ensure a tight grip upon the tile.

In one embodiment of the invention which is a modification of the construction described in U.S. Pat. No. 4,136,625 standard tiles as used in that concept can be employed but the locking member can be provided with the necessary internal dimensions to provide for angling of the pins or locating members described therein. In particular the locking member can be provided with an internal circular recess leading to a slightly narrower throat. Alternatively different locking members can be provided the throats of which angle to the vertical and depending on the degree of angle desired for a particular pin a different locking member can be employed.

The engagement of the head of the locking member within the recess in either the tile or locking member for the tiles can be assisted in the case of a non-spherical head on the locating member by supplementary head members which engage with the head at those points where it is desired to increase the contact between the head and the groove or recess in the tile or locking member.

The choice of the relative dimension between the entry into the recess and internal dimensions of the recess will be governed by the dimensions of the locating member and the head thereof to ensure that although the locating member can be angled in relation to the perpendicular nevertheless there is sufficient material at the entry into the recess to provide portions f the tile or locking member strong enough to resist a stress of the locating member against the edges of the entry into the recess.

The invention also provides a method of attaching tiles to support means by attaching, preferably by welding, locating elements to the support means so the locating elements project generally towards a center line of the support means and locating tiles in relation to said locating element by engaging recesses in the rear surface of the tiles or in locking members for said tiles with heads of the locating elements, the internal dimensions of the recesses in relation to the opening into said recesses and dimensions of the heads and bodies of the locating elements permitting said locating elements to be at an angle diverging from the perpendicualr to the front face of the tile.

There also forms a part of the invention a tile for use in a flame-injection throat said tile having a recess in the rear thereof having an internal dimension greater than the entry into said recess which permits angling of a locating element when mounted into said recess.

There is also provided a locking member preferably for use in locking tiles in a flame-injection throat which lock at the edges of adjacent tiles, which member has inwardly extending flanges to engage the head of a locating member the spacing between the flanges permitting angling of the locating member.

Preferably the recesses can be grooves of tapered or circular cross section the internal dimension of which is wider than the mouth of the recess, the recess extending across the width of the rear surface of a tile or at least sufficiently inwardly of one edge of the tile to permit entry of the head of the locating member. This locating element is then desirably a pin having a rounded or tapered head selected in accordance with the dimensions outlined above and remote from the point of attachment of the pin to the respective portion of the throat usually a tube. Usually the attachment would be by welding the head to the stem after adjustment to the desired proportion.

With such an arrangement after the shortest distance has been determined between the recess and the locating point on the throat, usually a tube, the locating element can be welded or otherwise attached to the tube, the head of the locating element guided into the recess in the side edge of the tile then the tile can be slid into its final position. Usually a bed of refractory cement will have been provided as a basis for the tile. If desired a part of the locating depression with a locating element therein can be completely filled with further refractory cement by injection. It may be desirable for the side edges of adjacent tiles to be of interlocking formation which can be achieved by forming a rib on one such edge and a groove complementary on the other edge both the rib and groove extending longitutinally on the respective edge. Alternatively as described in the modification of U.S. Pat. No. 4,136,625 edges can be provided with interlocking grooves and portions permitting entry of a locking member.

In some burners two adjacent rings of tiles are necessary to form the complete quarl. It is possible therefore to provide on said tiles at the engaging point of the rings interlocking complementary ribs and groove structures.

The invention will be better understood by reference to the accompanying drawings, in which.

Figure 1:
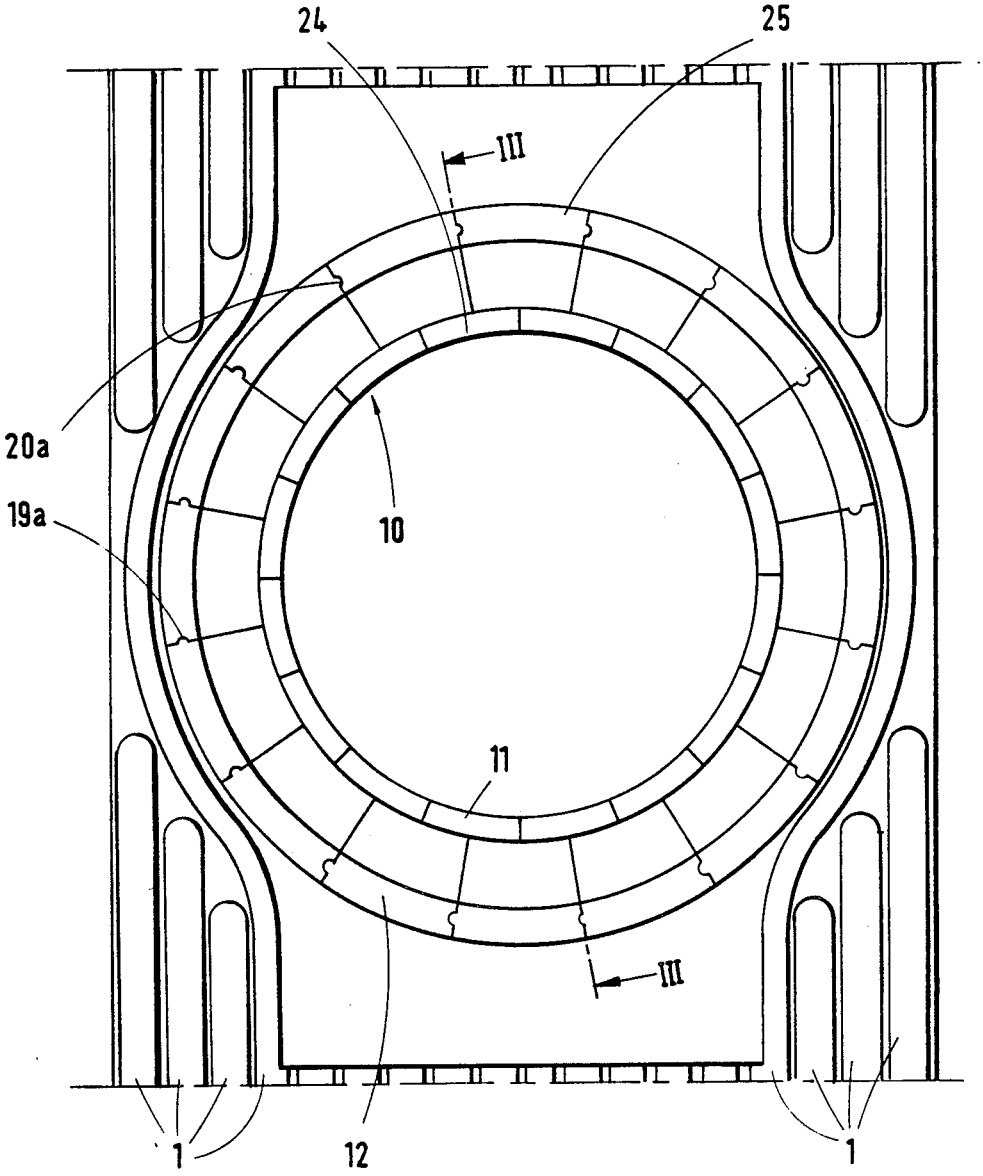
FIG. 1 is a front elevation of an injection throat for a boiler.

As shown in FIG. 1 banks of tubes 1 are arranged at opposite sides of the throat so that where they surround the throat they lie substantially normal to the axis of the throat. The throat is positioned directly below a burner 2 to form a flame-resisting liner through which the flame is directed into the body of the boiler.

Locating elements in the form of pins 3 are welded to certain of the tubes 1 at intervals around the circumference of the throat, and these elements project inwardly towards the centre line of the throat. Each such pin comprises a stem 31 welded at 32 to the respective tube 1 and a head 33 (tapered or frusto-conical in the prior art) which is moveable along the stem either by sliding or screwing on a threaded stem and after adjustment to the required position, is fixed at 34 to the stem by for example welding or with a locking means such as a nut on a threaded stem. Any excess length of stem projecting beyond the head is then cut away. A refractory cement 4 is applied to overlie the tubes 1, and partially embed the locating elements 3.

The throat is lined with a series of refractory tiles 10 which are moulded and pre-fired from a material such as silicon carbide. For the shape of throat shown in the Figures two basic types of tiles are used, rear tiles such as 11 and front tiles such as 12. The rear tiles have front and rear faces which are both curved to conform to the curvature of the throat, and which are in addition shaped so as to give the venturi shape of the throat. The front faces of each of these tiles is continuous and is substantially smooth and free from any recesses. The rear face of the rear tiles is interrupted by a locating groove 13 which is of wider internal cross-section (tapered in the prior art) with an internal dimension of the grooves being broader than the mouths, which opens into the rear face of the tile. The edges of the base of the groove may be radiused if desired. Each rear tile 11 has side edges 14 and **14*a* and rear and front edges 15 and 16. The front edge can be formed with rib 17 extending longitudinally along the centre of that edge. Each of the front tiles 12 has side edges 19 and 20 the edge 19 being formed with a rib 19*a* and the edge 20 with groove 20*a* complementary to the tib, both the rib and the groove extending longtudinally of the respective edge. The tile also has rear and front edges 21 and 22, the rear edge 23 which is complementary to the rib 17** on the front edge of each rear tile if so formed.

Figure 2:
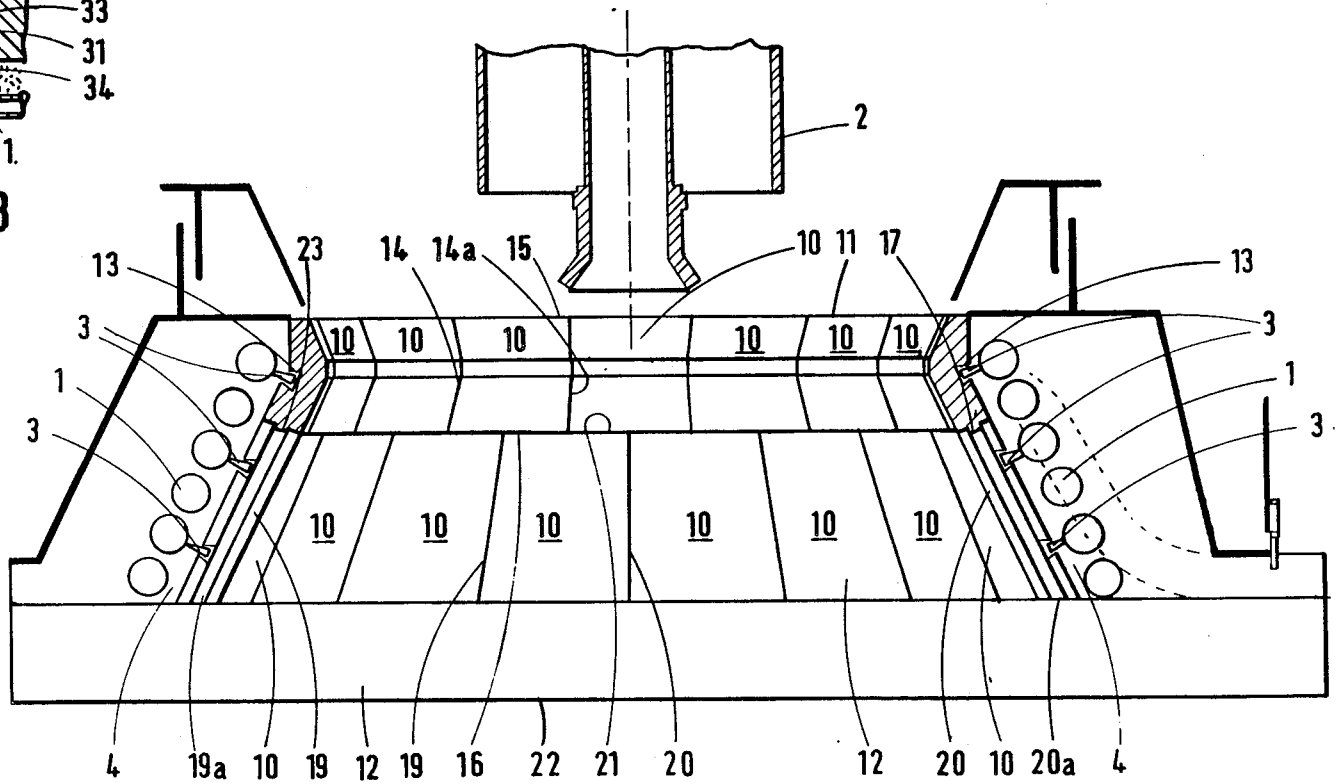
FIG. 2 is a cross-section on the line III—III of FIG. 1.
Figure 3:
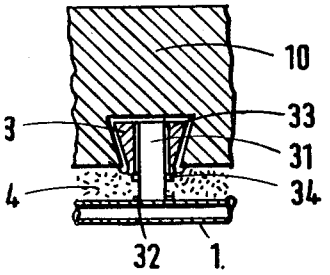
FIG. 3 is an enlarged cross-section of a detail of a throat according to the prior art.
Figure 4:
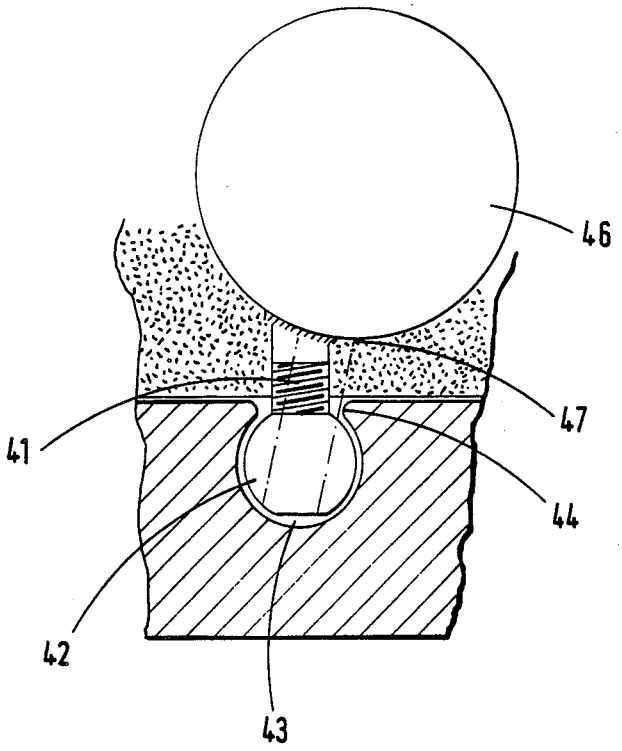
FIG. 4 is an enlarged cross-section of a detail of the retaining element and locating member of the present invention.

As shown in FIGS. 2 and 3 in the prior art it was important that the heads in any one set of locating elements were substantially coplanar in a plane perpendicular to the axis of the throat and lie in constant radius of the axis of the throat. For this purpose there is required a jig to set the heads.

In the present invention the head of the locating member 41 is a rounded spherical structure 42 and internal cross-section of the recess 43 is also rounded. The space between the edges 44 of the recess is sufficient to allow for some angular variation in the locating element so it could be located more closely to the crown of the tube 46 as shown by the dotted lines 47.

One can therefore mount all of the locating elements on the tubes to provide for the minimum length of locating member body between tube and surface of the tile.

First a layer of refractory bedding cement is applied to the area which the tile is to cover, to partially embed the locating element. A tile is then placed adjacent to the respective locating element or elements and moved sideways so that these elements enter the grooves 13, the tile bedding on to the cement and the grooves being filled with cement during this sideways movement. Additional cement may be injected into the grooves if required. The final tiles fitted n each of the two sets are those shown in FIG. 1 as 24 and 24, neither of which engage preset locating elements as clearly there is not the sideways clearance available for this to be done. These tiles are held in place by the effect of the cement, by the cooperating locating despressions and grooves, by the interlocking edges of adjacent tiles and by the general arched or circular configuration of the structure or by a pin and head located on a groove in the tile and the free end of the pin being welded to any available surface after the tile has been installed.

This last arrangement has the advantage that a regular tile can be used instead of a special tile. Also the relationship of locating member/head thereof and groove in the tile allows greater flexibility to move the pin or stem to the surface to whichit can be welded.

Thus, each set of tiles gives a substantially continuous lining around the circumference of an axial section of the throat, and each tile in each set has at least one locating depression engaged with a locating element on a respective tube.

After assembly of the tiles refractory caulking material is filled into all spaces and into any spaces between adjacent tiles.

Because the length of the locating member is minimised maximum amount of the locating member will be cooled by the tube; also the flexibility of mounting the tiles is greatly enhanced.

It is to be understood that in furnaces not associated with water-heating or steam-raising there may be no tubes surrounding the flame-injection throat. In such a situation the locating members will be attached to any other conveniently situated portion of the furnace structure.

Similarly in other structures involving attachment of tiles in vertical or inclined structures or to the lower side of horizontal surfaces, the locating member can readily be inserted to the best angle for attachment to the appropriate support surface.

I claim:

1. A combination of ceramic tiles and locating elements for locating and supporting the ceramic tiles relative to a main support to which the locating elements are attached, the locating elements each having a elongate body, an enlarged head at one end and at the opposed end is attachable to the main support; the ceramic tiles each defining a recess in its rear surface, the recess having a substantially corresponding cross-section to that of the enlarged head of the elongate locating elements in the axial direction thereof, the diametric width of the recess being greater than the width of the opening to the recess and the width of the opening being substantially wider than the width of the elongate body of the locating member so that the locating member is rotatable within the recess in a direction transverse to the longitudinal axis of the locating member to move the said elongate body between opposed sides of the recess opening.

2. A method of attaching ceramics tiles to support means, comprising attaching locating elements to the support means so the locating elements project generally towards a center line of the support means, locating tiles in relation to said locating elements by engaging an enlarged head of an elongate locating element in a recess defined in the rear surface of a respective tile, the internal diametric width of the recess corresponding to that of the enlarged head of a respective locating element being greater than the width of the recess opening defined in the rear surface of a tile, and moving a tile and locating element relative to each other to effect movement of the locating element across the width of the recess opening in a direction transverse to the longitudinal axis of the elongate locating member to an angle diverging from the perpendicular to the front face of the tile.

3. A tile in which the rear surface defines a recess therein of an internal cross-section corresponding in at least one direction to that of an enlarged head of a locating element mountable therein and having a diameter of a length greater than the width of the entry into said recess and the width of said entry being substantially greater than the width of the locating element to permit angling of the locating element when located in said recess.

4. A method of attaching tiles via locating elements to tubes constituting a main support so that the locating elements project generally toward a centre line of the tubes, locating tiles in relation to said locating elements by engaging each locating element in a recess defined in the rear surface of each respective tile, each recess having a cross-section corresponding to that of an enlarged head of a respective locating element, the internal diametric width of each recess being greater than the width of the recess opening, and the width of the elongate body of the locating element permitting each locating element to be moved in a direction transverse to the longitudinal axis of the elongate locating member to an angle diverging from the perpendicular to the front face of the tile.

5. A combination according to claim 1 wherein th head of the locating element is spherical and the recess is circular in cross-section.

6. A combination according to claim 1 wherein the support means comprises a flame injection throat for a furnace.

7. A method according to claim 2, including attaching the tiles via the locating elements to tubes or other elements constituting the support means to form a flame injection throat of a boiler.

* * * * *